United States Patent [19]

Flugger

[11] Patent Number: 5,019,124

[45] Date of Patent: May 28, 1991

[54] TRAY

[76] Inventor: Frederick F. Flugger, 1219 Muriel St., Pittsburgh, Pa. 15203

[21] Appl. No.: 530,115

[22] Filed: May 29, 1990

[51] Int. Cl.[5] ..... B65D 1/36

[52] U.S. Cl. ..... 206/45; 206/560; 206/564

[58] Field of Search ..... 206/563, 45, 860, 562, 206/564

[56] References Cited

U.S. PATENT DOCUMENTS

| | | | |
|---|---|---|---|
| D. 223,026 | 2/1972 | Rotkow | 206/563 |
| 1,990,398 | 2/1935 | Beddingfield | 206/45 |
| 4,068,760 | 1/1978 | Johnson, Jr. | 206/564 |
| 4,202,569 | 5/1980 | Thuringer | 206/564 |
| 4,320,838 | 3/1982 | Braver | 206/564 |
| 4,753,341 | 6/1988 | McIntyre | 206/45 |
| 4,872,723 | 10/1989 | Kopf | 206/564 |

*Primary Examiner*—Joseph Man-Fu Moy

*Attorney, Agent, or Firm*—Webb, Burden, Ziesenheim & Webb

[57] ABSTRACT

A tray having a base defined by the upper portions of two sidewalls, a forward edge extending between the upper portions of the sidewalls and a raised back wall extending between the opposite ends of upper portions of the sidewalls. The sidewalls are the apexes of the triangles located at the forward edge of the base so that the base extends at an upward angle from the forward edge to the base of the raised back wall. A plurality of individual depressions are formed in the base and a plurality of individual recesses are formed in the raised back wall. Each depression and each recess is intended to hold an item.

16 Claims, 2 Drawing Sheets

TRAY

BACKGROUND OF THE INVENTION

1. Field of the Invention

The invention relates generally to a tray and more particularly to a tray made of a plastic material and having multiple compartments sized and shaped to removably hold various functional items which are frequently used by bedridden persons, immobile persons and persons with limited mobility.

When a person is partially immobile or bedridden, there are many small functional items which must be conveniently located for the person to readily use without calling for assistance. In the past, these items have generally been stored in a bedside stand or in a drawer of a bed table. However, these arrangements are generally unsatisfactory because the items become intermixed and entangled so that it is often difficult for the person to locate and grasp the desired item and remove it for use. Additionally, some items, such as a clock, must be visible at all times to be of value. In addition to providing individual storage compartments for various items, the tray provides compartments to hold a plate, a beverage container and eating utensils.

SUMMARY OF THE INVENTION

The invention is a novel tray having a plurality of open top compartments of different sizes and shapes for receiving different functional items which are of use to an immobile person. The tray is made of a relatively rigid plastic and, in addition to the compartments for permanently storing items, it has compartments for receiving a plate, a beverage container and eating utensils.

The tray is injection molded from a thermoplastic material such as, for example, a polyacrylate, a high density polyethylene, a polyurethane, polyvinyl chloride or polybutadiene-urethane. Anyone of these materials will produce a rigid lightweight tray, having a smooth hard surface to permit easy cleaning. The tray has a rectangular wedge shape in cross section with a raised back wall, which joins the upper portions of the left and right side walls that slope downwardly from the base of the back wall toward the lower front edge. The three walls surround a work surface defined by a base wall that rises at an angle from the front edge to the base of the back wall. The higher back wall makes items stored therein readily visible and permits them to be easily grasped without interfering with other items. The raised rear edge of the base permits the formation of deeper compartments for storing elongated items at the rear portion of the base. Additionally, the back wall and the two sidewalls cooperate to prevent an item accidentally dropped onto the work surface of the tray from falling off the work surface. The tray is provided with hand notches in the side retainer walls so that it can be easily lifted.

Other objects and advantages of the invention will be readily apparent from the following detailed description and the drawings appended hereto, wherein like reference characters indicate like parts throughout.

DETAILED DESCRIPTION OF THE PREFERRED EMBODIMENT

The tray is unitary and is injection molded from a plastic sheet material such as polyacrylate, high density polyethylene, polyurethane, polyvinyl chloride or polybutadiene-urethane. The tray is rigid, lightweight and has a hard, smooth surface which can be easily cleaned. The tray has a plurality of individual compartments for holding various items.

Figure 1:
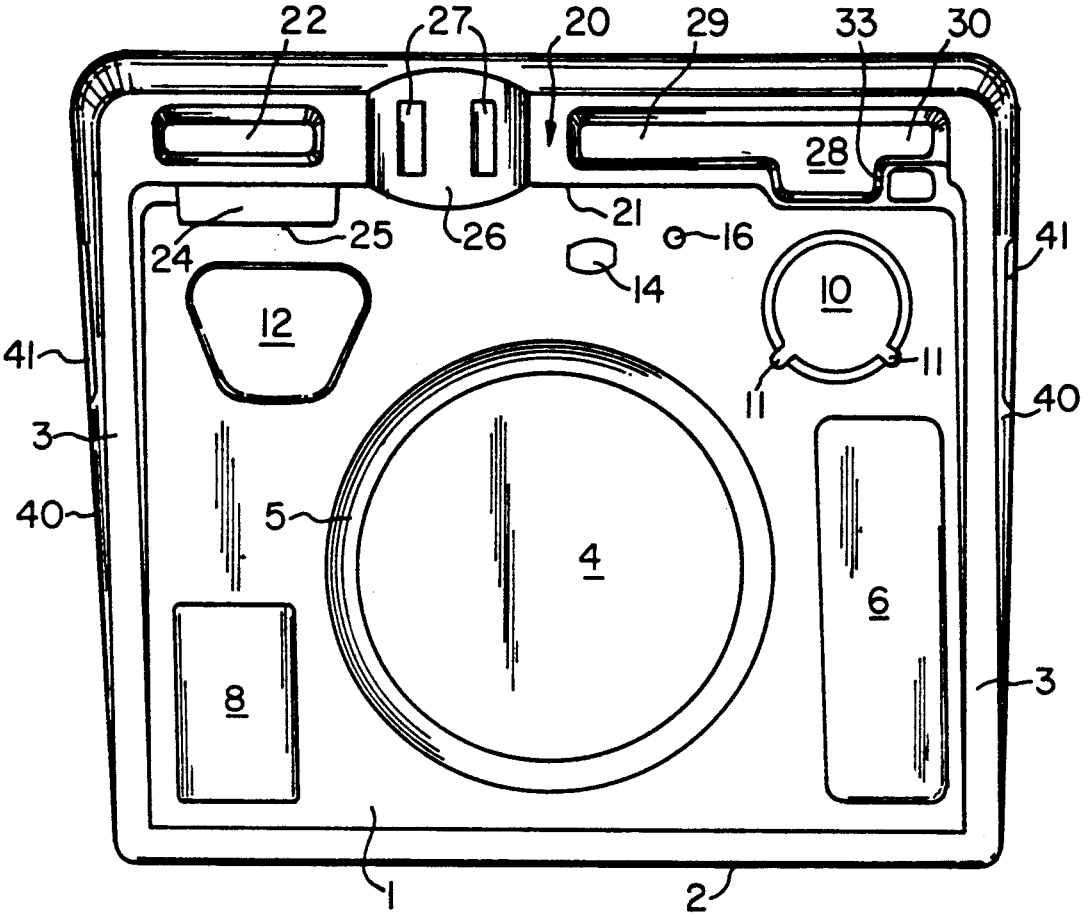
FIG. 1 is a plan view of the tray of the invention.
Figure 2:
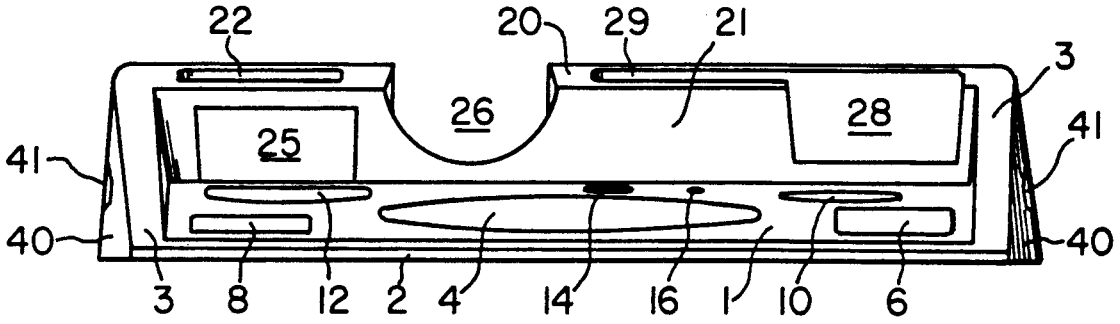
FIG. 2 is a front elevation of the tray.
Figure 3:
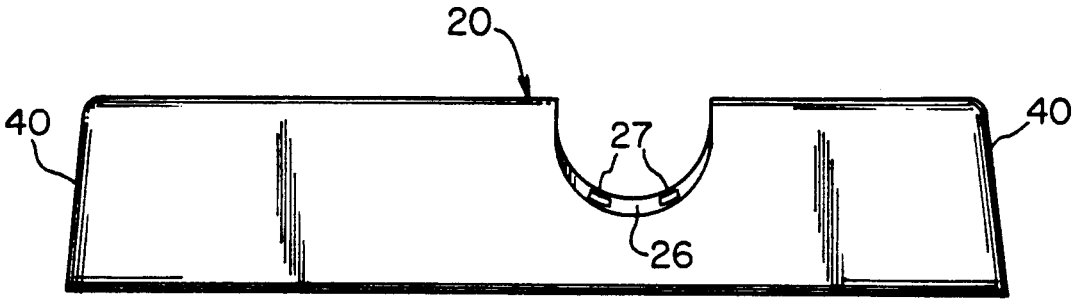
FIG. 3 is a rear elevation of the tray.

As shown in FIG. 1 of the drawings, the tray has a base 1 with a lower forward edge 2 and spaced substantially parallel side walls having upper portions 3. Each side wall is a triangular-shaped support member with the upper portion forming a retainer wall and the apex of the triangle located at the lower forward edge 2 of base 1. A raised back wall 20 extends along the rear of the tray base and joins the upper portions 3 of the right and left side walls 40. The three walls surround a work surface which is defined by a continuously inclined base wall that rises at an angle from the forward edge 2 to the back wall 20 and is spaced below the upper portions 3 of the surrounding walls 20 and 40. The inclined base wall and its work surface have a large circular, relatively shallow depression 4 at the approximate center which is adapted to receive a plate (not shown). The circumference of depression 4 is formed with a ledge 5 raised from the bottom of the depression in order to receive the rim of a plate. An elongated rectangular, relatively shallow depression 6 adapted to hold eating utensils is located on the right side of circular depression 4 and another rectangular depression 8 is located on the left side of circular depression 4 and is intended to hold a package of tissues or a napkin.

A cylindrical, relatively deep depression 10 having a pair of cutouts 11 coextensive therewith is located above elongated depression 6. The depression 10 is adapted to hold a beverage container such as a glass, a cup or a mug. When a cup or a mug is located in depression 10, the outwardly extending handle is located in one of the cutouts 11. The cutout 11 directed toward the upper portion 3 of the right sidewall will receive the lower end of the handle for a right-handed person and the inwardly directed cutout 11 will receive the lower end of the handle for a left-handed person. It will be noted that the cutouts are located at approximately 45° from the vertical axis of depression 10. While the exact angular orientation of the cutouts is not critical, it has been found that the above-described angular positions make the use of the cutouts for receiving the lower end of a handle convenient for the user.

A truncated triangular, relatively deep depression 12 adapted to hold a container having an outer shape so as to fit snugly into the depression is located in the corner of base opposite the corner having cylindrical depression 10. The container may have an open top, a removable lid or a hinged lid, and is adapted to contain such things as dentures or small change such as needed in a hospital to purchase newspapers or other merchandise from a gift cart. Other uses of the container will become apparent to those skilled in the art and applicant does not limit the use of the container to those described hereinabove.

A depression 14 adapted to hold a flashlight in the vertical position is located in the upper center of tray base 1 and a cylindrical depression 16 adapted to hold a slender cylindrical object such as the handle of a magnifying glass, a pen or a pencil, is located between depressions 10 and 14. A number of depressions 16 may be formed in this area of tray base 1, if desired.

The depressions 10, 12, 14 and 16 in the tray base are deeper than the depressions 4, 6 and 8 because they are located in the raised portion of the tray base 1. This is advantageous because the items stored in these depressions are generally elongated.

A raised back wall 20 extends along the rear of the tray base between upper portions 3 of the sidewalls. The left end of back wall 20 is formed with a rectangular recess 22 adapted to hold an eyeglass case or a similarly shaped item. Immediately forward of recess 22 and formed as a part of the front wall 21 of back wall 20 is a rectangular recess 24 having walls 25 which are integral with the front wall 21 of the back wall. Recess 24 may be used to hold a number of items such as nail clippers, nail files, a note pad, an address book or other small items which a person wants to have readily available.

A semicircular, open-top notch-like recess 26 is located next to recess 22 in back wall 20. The notch-like recess is adapted to receive the lower portion of a cylindrical clock to retain it in a position to be readily visible. A pair of radially spaced parallel rectangular openings 27 are formed in the bottom wall of recess 26 to receive the legs of a circular alarm clock.

A generally rectangular recess 28 is located in back wall 20 next to recess 26. Recess 28 has a narrow portion 29 adapted to hold a mirror or other thin flat object. A section of the front wall 21 of back wall 20 is cut away at one end of recess 28 to create an opening and provide access to an end 30 of recess 28. The end 30 is adapted to hold various small items such as an eyeglass cleaning mist container which a person wants to have readily available. A small square section 32 of the end 30 of recess 28 is divided from the rest of end 30 by walls 33. Section 32 is intended to hold a comb and the handle of a hairbrush in the vertical position. This arrangement makes it extremely convenient for a person to grasp the hairbrush and/or the comb when desired.

While various recesses and depressions in the tray base and the back wall are described herein in conjunction with different items, it will be understood by those skilled in the art that other items having a size and shape making it convenient to store them in a recess or a depression may be placed therein. Thus, the tray is not limited to the items described hereinabove.

Figure 4:
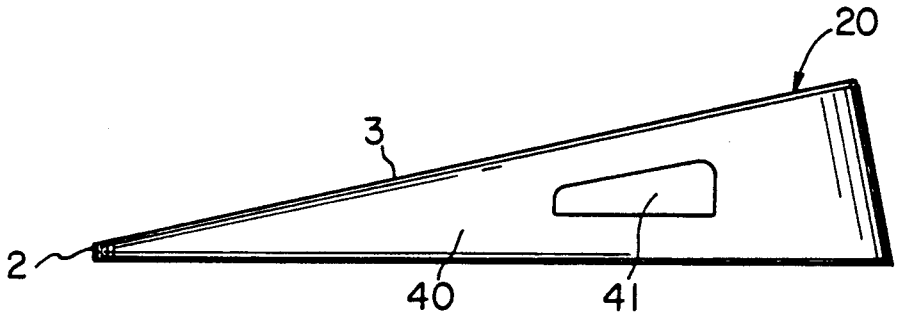
FIG. 4 is a side elevation of the tray.

As shown in FIG. 4 of the drawings, each side wall 40 of tray base is formed with a generally triangular-shaped recess 41 so that a person desiring to lift the tray can position the fingers of the left hand in the recess in the left-hand sidewall of the tray and the fingers of the right hand in the recess in the right-hand sidewall of the tray. When the fingers are placed in recessions 41 and the thumbs are placed on the upper surfaces of upper portions 3 of the sidewalls, the tray can be easily lifted and moved from one location to another.

While the invention has been described hereinabove, in conjunction with the drawings, it is to be understood that the invention may be otherwise embodied within the scope of the appended claims.

I claim:

1. A tray having a base, said base defined by two substantially parallel upper portions of sidewalls a forward edge extending between first ends of said upper portions and a raised back wall extending between second opposite ends of said side upper portions, an upstanding triangular sidewall below each of said upper portions, the apexes of said triangular sidewalls located at said forward edge of said base, said base including a continuously inclined base wall which extends at an upward angle from said forward edge to the base of said raised back wall and spaced below said upper sidewall portions, a plurality of individual depressions having different shapes and sizes formed in said base wall and a plurality of individual recess having different shapes and sizes formed in said raised back wall whereby each of said depressions and each of said recesses is adapted to hold an item, the exterior of each of said triangular sidewalls having recessed handle means formed therein for receiving the fingers of a hand whereby said tray can be easily lifted.

2. A tray as set forth in claim 1, wherein at least one of said depressions is circular and is located substantially central of said base and is adapted to hold a plate.

3. A tray as set forth in claim 1, wherein at least one of said depressions is rectangular and is adapted to hold eating utensils.

4. A tray as set forth in claim 3, wherein another of said depressions is rectangular and is adapted to hold a package of tissues.

5. A tray as set forth in claim 1, wherein at least one of said depressions is a frustotriangle and is adapted to hold a container.

6. A tray as set forth in claim 1, wherein at least one of said depressions is adapted to hold a vertically positioned flashlight.

7. A tray as set forth in claim 1, wherein at least one of said depressions is circular and a plurality of depressed cutouts extend radially outward from the circumference of said circular depression whereby said circular depression is adapted to hold a beverage container.

8. A tray as set forth in claim 1, wherein one of said recesses in said raised back wall is an open top notch adapted to hold a clock.

9. A tray as set forth in claim 8, wherein two radially spaced openings are formed in the wall of said notch to receive the legs of a clock.

10. A tray as set forth in claim 1, wherein one of said recesses in said raised back wall is rectangular and is adapted to hold an eyeglass case.

11. A tray as set forth in claim 10, including a wall extending forwardly from the front wall of said raised back wall to form a rectangular recess extending forwardly from said front wall of said raised back wall.

12. A tray as set forth in claim 1, wherein said raised back wall has a relatively narrow, elongated recess formed therein with a partially open front whereby said elongated recess is adapted to hold a mirror and other small items.

13. A tray as set forth in claim 12, wherein a portion of said recess is divided from the rest of said recess by walls to form a separate small recess adjacent to said elongated recess and said separate recess is adapted to hold a comb and/or a brush handle.

14. A tray as set forth in claim 1, wherein said tray is made from one of polyacrylate, polyethylene, polyurethane, polyvinyl chloride, polybutadiene-urethane or polypropylene.

15. A tray as set forth in claim 1, wherein said handle means is a generally triangular shaped notch formed in each of said sidewalls.

16. A tray as set forth in claim 1, wherein depressions formed in said base located adjacent to said back wall are deeper than depressions formed in said base located adjacent to said forward edge of said base.

* * * * *

UNITED STATES PATENT AND TRADEMARK OFFICE

CERTIFICATE OF CORRECTION

PATENT NO. : 5,019,124

DATED : May 28, 1991

INVENTOR(S) : Frederick F. Flugger

It is certified that error appears in the above-identified patent and that said Letters Patent is hereby corrected as shown below:

TITLE PAGE: under References Cited U.S. PATENT DOCUMENTS insert

--4,254,872 3/1981 Garrett ... 206/561
3,656,681 4/1972 Goings ... 229/15
3,601,277 8/1971 Andrews et al. ... 220/20
D. 221,035 6/1971 Raines .
3,305,124 2/1967 Whiteford ... 220/63
2,790,547 4/1957 Sutton ... 206/72
2,652,702 9/1953 Hintze ... 65/15--.

Column 2 Line 56 after "base" insert --1--.

Column 3 Line 48 after "base" insert --1--.

Column 3 Line 53 "recessions" should read --recesses--.

Claim 1 Line 7 Column 4 "recess" should read --recesses--.

Signed and Sealed this

Twenty-fourth Day of November, 1992

*Attest:*

DOUGLAS B. COMER

*Attesting Officer*

*Acting Commissioner of Patents and Trademarks*